US005941765A

United States Patent [19]

Taylor

[11] Patent Number: 5,941,765

[45] **Date of Patent: *Aug. 24, 1999**

[54] SANDER

[75] Inventor: Robert W. Taylor, Jackson, Tenn.

[73] Assignee: Porter Cable Corporation, Jackson, Tenn.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/752,638

[22] Filed: Nov. 19, 1996

[51] Int. Cl.[6] ..... B24B 23/03

[52] U.S. Cl. ..... 451/359; 451/357; 451/453; 451/456

[58] Field of Search ..... 451/359, 357, 451/344, 456, 453; 55/523

[56] References Cited

U.S. PATENT DOCUMENTS

| | | |
|---|---|---|
| Re. 29,247 | 6/1977 | Kilstrom et al. . |
| D. 326,398 | 5/1992 | Fushiya et al. . |
| 2,499,933 | 3/1950 | Smul . |
| 2,895,266 | 7/1959 | Statler . |
| 2,929,177 | 3/1960 | Sheps . |
| 3,123,946 | 3/1964 | Hoveland . |
| 3,168,336 | 2/1965 | Lawrence . |
| 3,594,958 | 7/1971 | Cusumano . |
| 3,673,744 | 7/1972 | Olimoen . |
| 3,785,092 | 1/1974 | Hutchins . |
| 3,824,745 | 7/1974 | Hutchins . |
| 3,826,045 | 7/1974 | Champayne . |
| 3,862,521 | 1/1975 | Isaksson . |
| 3,964,212 | 6/1976 | Karden . |
| 3,987,589 | 10/1976 | Marton . |
| 4,062,152 | 12/1977 | Mehrer . |
| 4,071,981 | 2/1978 | Champayne . |
| 4,135,334 | 1/1979 | Rudiger . |

(List continued on next page.)

FOREIGN PATENT DOCUMENTS

| | | |
|---|---|---|
| 931761 | 8/1973 | Canada . |
| 1032349 | 6/1978 | Canada . |
| 1049265 | 2/1979 | Canada . |
| 1063806 | 10/1979 | Canada . |
| 1080477 | 7/1980 | Canada . |
| 3602571 A1 | 7/1987 | Germany . |
| 3702-960 | 8/1988 | Germany . |
| 55-112759 | 8/1980 | Japan . |
| 747-700 | 7/1980 | Russian Federation . |
| 1408522 | 10/1975 | Sweden . |

OTHER PUBLICATIONS

Brochure entitled "POREX Porous Plastic Materials", Porex Technologies, Fairburn, Georgia, 1990.

Brochure entitled "An Introduction to Interflo", Interflo, a Division of Chromex Corporation, Brooklyn, New York.

Nagyszalanczy, Random–Orbit Sanders, *Fine Woodworking,* Jul./Aug. 1993 pp. 43–47.

Catalog entitled "Black & Decker Industrial Construction Division, Heavy Duty Professional Power Tools & Accessories for Construction and Industry", The Black & Decker Corporation, Towson, Maryland, p. 48.

Exhibit A, photographs of Black & Decker 4020–10 sander.

*Primary Examiner*—Eileen P. Morgan
*Attorney, Agent, or Firm*—Merchant & Gould P.C.

[57] ABSTRACT

A sander includes a sander body, a motor held by the sander body, a pad operably connected to the motor so as to impart an orbital motion to the pad, a housing swivellably attached to the sander body, and bumped structure between the housing and the sander body. The bumped structure is constructed and arranged for imparting friction between the housing and the sander body to increase a force required to swivel the housing about the sander body. A groove having a wall is defined in at least one of the housing and the sander body, and the bumped structure includes a plurality of protuberances along the wall of the groove. The housing includes a dust exhaust channel attached to a filter housing, and the filter housing includes a rigid, porous material having a pore size effective for entrapping dust which enters the filter housing.

18 Claims, 7 Drawing Sheets

U.S. PATENT DOCUMENTS

| | | | |
|---|---|---|---|
| 4,158,935 | 6/1979 | Robert . | |
| 4,164,101 | 8/1979 | Robert . | |
| 4,322,921 | 4/1982 | Maier . | |
| 4,328,645 | 5/1982 | Sauer . | |
| 4,616,449 | 10/1986 | Marton . | |
| 4,754,575 | 7/1988 | Schneider . | |
| 4,759,152 | 7/1988 | Berger et al. . | |
| 4,851,730 | 7/1989 | Fushiya et al. . | |
| 5,018,314 | 5/1991 | Fushiya et al. . | |
| 5,125,190 | 6/1992 | Buser et al. . | |
| 5,206,967 | 5/1993 | Fushiya et al. . | |
| 5,237,781 | 8/1993 | Demetrius . | |
| 5,261,190 | 11/1993 | Berger et al. . | |
| 5,280,738 | 1/1994 | Liou | 81/177.8 |
| 5,384,984 | 1/1995 | Smith | 451/344 |
| 5,518,442 | 5/1996 | Clowers et al. . | |

SANDER

BACKGROUND AND SUMMARY OF THE INVENTION

The present application is directed to sander improvements. These improvements include a pad sander lower housing having a skirt which flares out over the periphery of the sanding pad. The lower housing can be selectively swiveled in a rotational manner to a position desired by the user. This has particular advantages in dustless versions of a sander in which it may be desirable to reposition the dust collection system.

A further improvement relates to the protection of a user's hand. Palm-grip random orbit sanders sometimes are configured so that the sanding pad may begin spinning at high speed when the sander is lifted off of the work. Since palm-grip random orbit sanders can be grasped by a single hand in a manner that might put the user's fingers in contact with a high speed spinning pad, protection against injury is desirable. To this end, the present application discloses a protective skirt which flares out over the periphery of the pad in a palm-grip random orbit sander. The skirt may be configured for either dustless versions of such sanders, in which case the skirt typically also forms a portion of the dust collection system, as well as with dusty versions of the sander, in which case the primary purpose of the skirt is to prevent contact of the user's hand and fingers with the pad.

In sanders with dust collectors, particularly those that use passive systems such as a cloth bag to catch dust, the dust collection apparatus can be both relatively cumbersome and ineffective. In an improvement to such passive systems, the present application discloses a sander dust collector filter housing formed of a rigid, porous material for entrapping dust. Such a dust collection system can be made in a compact manner which is particularly suitable for palm-grip sanders, whether the sander be of an orbital, dual action, or random orbit type. Larger versions of such filter housings may be used with larger sanders.

DETAILED DESCRIPTION OF THE PREFERRED EMBODIMENTS

Figure 1:
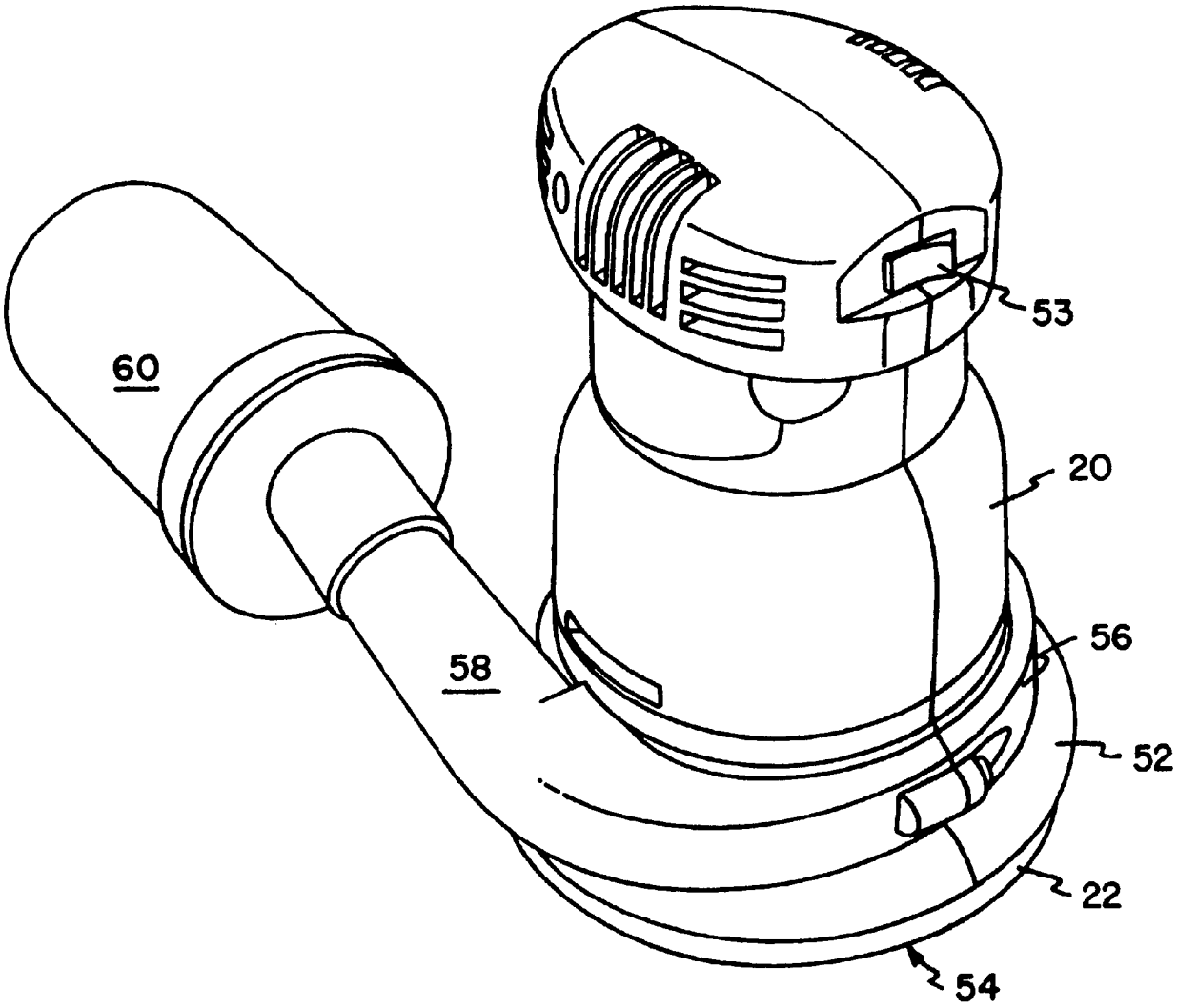
FIG. 1 is a perspective view of a sander which incorporates a dust collection system.
Figure 1A:
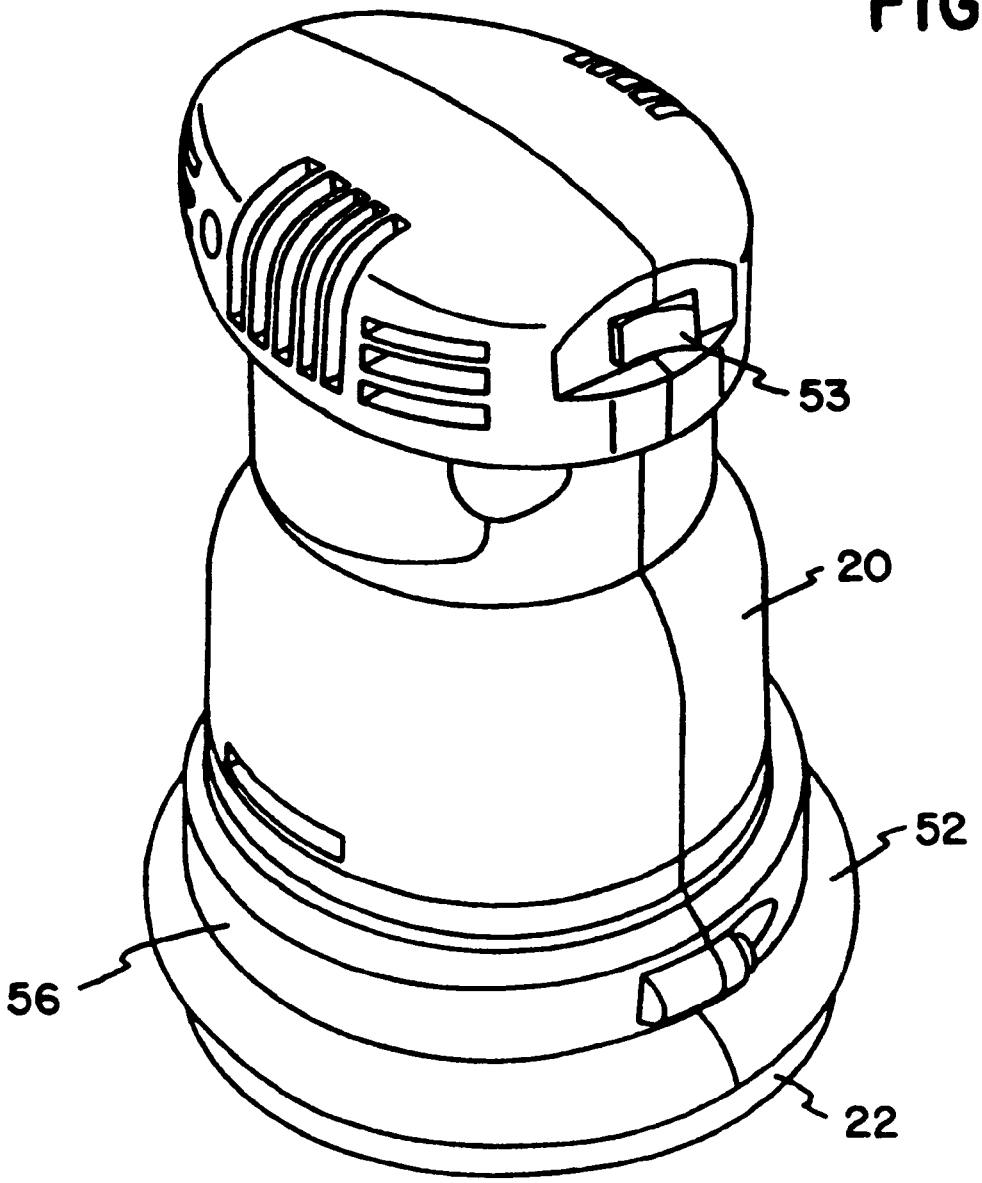
FIG. 1A illustrates a similar sander without a dust collection system.

FIG. 1 illustrates a sander having a body or housing 20 which is typically comprised of two halves secured together by conventional means and a pad 22 for holding sandpaper or other abrasives or materials (e.g., polishing pads) desired by the user. Such pads 22 can be configured in the pressure sensitive adhesive (PSA) variety as well as a hook and loop variety, each of which are familiar to those skilled in the art, and can be either with or without holes to incorporate either a sander with dust collection capability (for example, as shown in FIG. 1) or without such capability (for example, as shown in FIG. 1A). Pad 22 has an outer periphery substantially defining the size of sandpaper or other material supported by the pad.

The sander shown in FIGS. 1 and 1A have a body or housing 20 sized for a palm grip at the top of the housing and for a single-handed grip around the body. A motor housed by body 20 typically comprises an armature 24, a field 26, and brush and spring assemblies 28. Upper and lower ball bearings 30 and 32 are supported by the housing and provide stability and smooth operation for motor shaft 34. For a random orbit sander of the type shown, motor shaft 34 is typically directly coupled to a counterweight 36, which may incorporate integral fan blades 37 used for dust collection.

In the embodiment shown, pad support 38 is coupled to counterweight 36 by a ball bearing 40 having its outer race diameter press fit into a cylindrical cavity 42 defined by pad support 38 and the inner diameter of its race slip fit onto an eccentrically-located cylindrical protrusion 44 of counterweight 36. The connection between counter-weight 36 and pad support 38 imparts an orbital motion to the pad support 38. Pad support 38 is shown further secured to armature shaft 34 by a machine screw 46, which ensures a secure assembly of the counterweight 36, bearing 40 and pad support 38. Pad 22 is typically secured to pad support 38 by threaded machine screws 48.

As has previously been indicated, the sander motor in the embodiment shown is powered electrically and for this purpose includes a power cord 50 with power being controlled by an on/off switch 53. Those skilled in the art will recognize many other components illustrated in the cross-section of FIG. 3 as being typical to the assembly of an electrically-driven sander of a random orbit nature. Those skilled in the art will also recognize that suitable components of the sander shown could be replaced with well-know components if a sander of the orbital or dual-action variety is desired. Furthermore, in embodiments driven by an air motor, power cord 50 would be replaced by an air hose, and the components previously described which relate an electric motor would be replaced with suitable air motor components. Motors used in the preferred embodiments have a typical no-load speed of 12,000 RPM.

For the preferred random orbit sanders shown in the present application, when a sander is not in contact with the work, the rotational restraint established between the inner race, balls, seals, grease, and the outer race of the bearing 40 causes the pad assembly to spin at the same speed as the motor shaft. When the abrasive or other material mounted to pad 22 contacts the work, another rotational restraint is created which opposes the bearing restraint. This additional restraint varies with pressure, abrasive grade, etc. Through this process, the rotational speed of pad 22 (i.e., of the outer race of bearing 40) is reduced to approximately 300

RPM, while the orbital motion (inner race of bearing 40) continues at a higher speed (12,000 OPM). In this manner, since the rotational speed of the pad is not synchronized with the orbital motion of the pad, the abrasive particles are made to travel in a "random orbital motion."

The sanders shown in the present application comprise a skirt 52 which flares out radially toward the periphery 54 of pad 22 so that it protrudes over a periperhal portion of the pad. In this manner, a skirt or similar protuberance 52 serves to help prevent the fingers of a user's hand from sliding down the sander body or housing and contacting a peripheral portion of the pad 22 during sanding operations. As with housing 20, skirt 52 is preferably formed of a rigid material (for example, polyamide) and is spaced slightly upward from pad 22, giving pad 22 sufficient clearance from skirt 52 so that the sander can operate properly and so that dust can be pulled up between the periphery of pad 22 and skirt 52 by fan blades 37. As previously indicated, fan blades 37 may be integrally formed in a central open region interior to counterweight 36.

In the preferred embodiment, skirt 52 is formed integrally with a lower housing 56, which is configured so that it can be selectively rotated about sander body 20 for enabling the lower housing to be oriented in a position desired by the user. The position selected by the user is typically maintained by friction between the exterior lower portion of the sander body 20 and the interior portion of lower housing 56, each of which have complementary shapes to ensure retention of the lower housing on the sander body while enabling rotational adjustment. The ability to adjustably position lower housing 56 is particularly advantageous when lower housing 56 comprises a dust collection system defining a dust exhaust channel such as 58. Such a dust exhaust channel may be coupled either to a passive dust collector such as a bag or filter housing 60 or by a hose to an active system such as a vacuum cleaner. In these scenarios, users may wish to adjust the position of the collection system with respect to sander or workpiece features.

Figure 2:
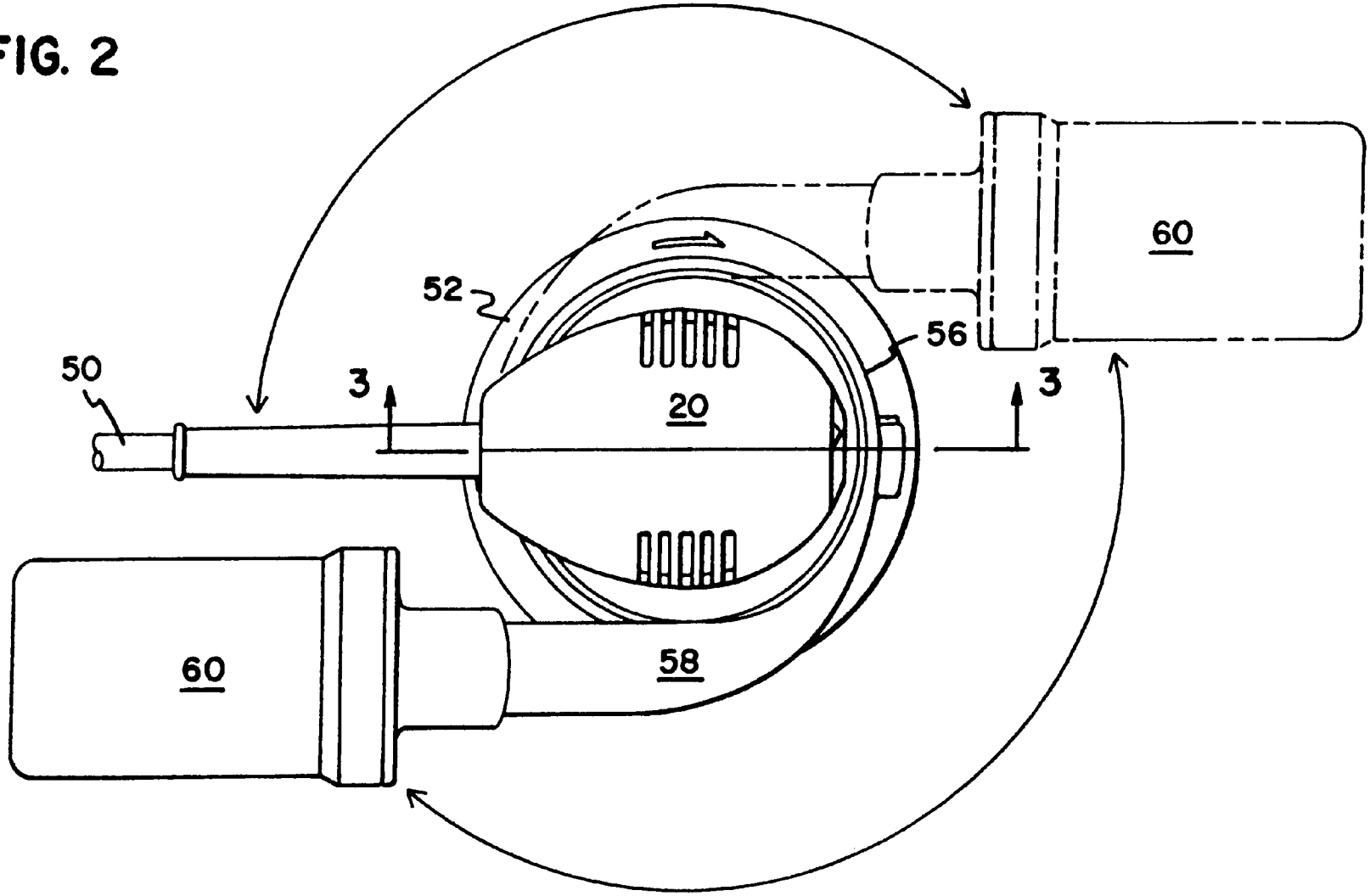
FIG. 2 is a top view of a sander showing a dust collection system which can be rotationally oriented in a direction selected by the user.

As with body 20, lower housing 56 may comprise two halves secured together by conventional means. For the version of the sander disclosed which incorporates dust collection, dust collection channel 58 is defined in part by a portion of lower housing 56. FIG. 2, which is a top plan view of the preferred sander embodiment comprising a passive dust collection system, illustrates how lower housing 56 may be selectively swiveled in a rotational manner to a position desired by the user. As can be seen, such positioning will enable the user to orient the direction of exhaust port 58 in a preferred direction relative to, for example, power cord 50.

Figure 4:
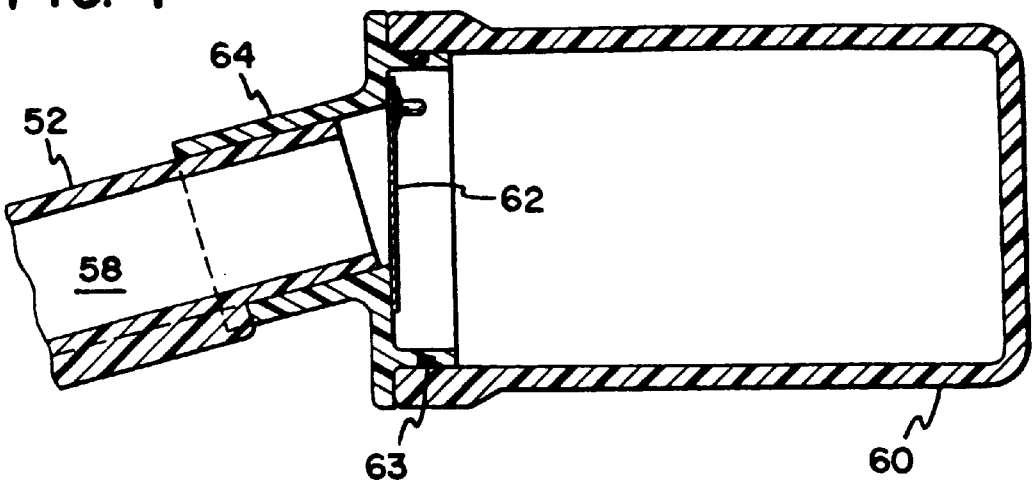
FIG. 4 illustrates a dust collection housing.
Figure 5:
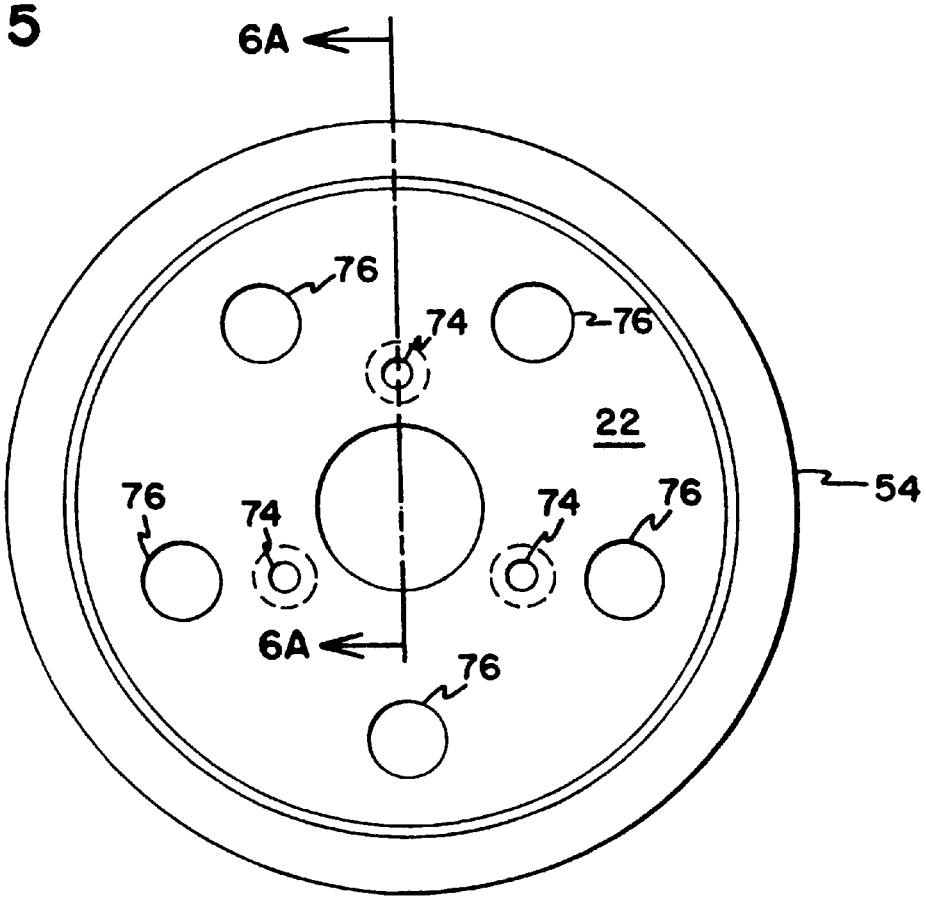
FIG. 5 illustrates a top plan view of a sanding pad which incorporates dust collection holes.
Figure 6A:
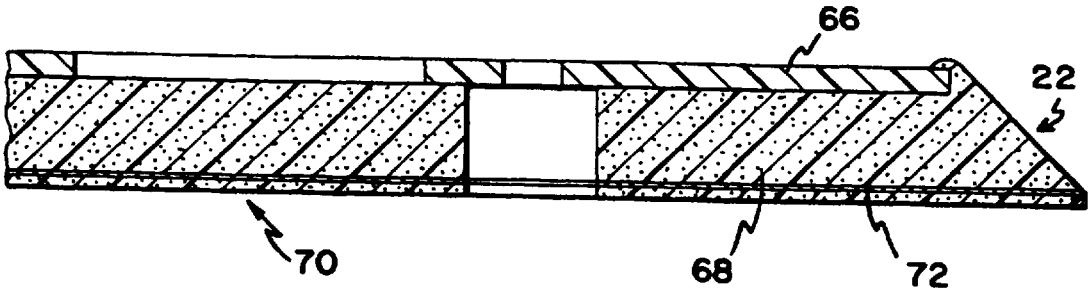
FIGS. 6A and 6B illustrate alternative embodiments of a sander back-up pad.
Figure 6B:
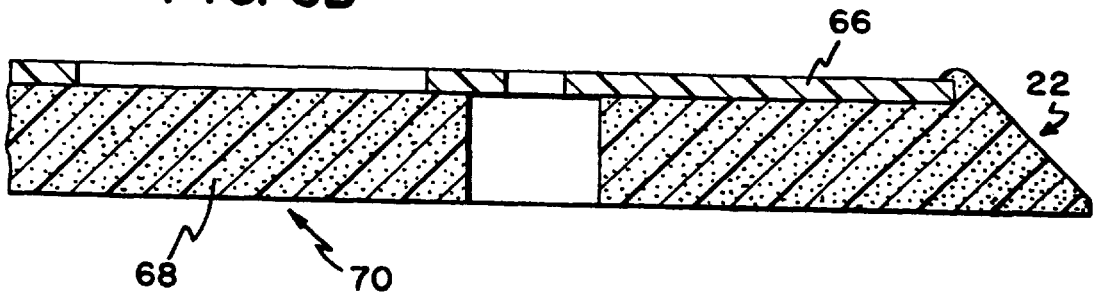

The preferred dust collection system is shown cross-sectionally in FIG. 4. Note that the preferred system incorporates a membrane 62 which maintains a normally closed position in order to prevent the back flow of dust collected within filter 60 while enabling dust to enter the filter. Membrane 62 may be formed of polyester film having a nominal thickness of 0.007 inch. Filter housing 60 is typically coupled via friction fit to an adapter 64, which in turn fits fictionally over dust exhaust channel 58 of housing 52 in order to removably interconnect the filter and adapter assembly with the sander exhaust port. O-ring 63 retained in place by a detent in adapter 64 helps maintain a good friction fit and seal for enabling long-life and easy removal of housing 60 from adapter 64. When filter housing 60 is full of dust, it can be removed from adapter 64 and emptied by simply twisting housing 60 off of adapter 64 and tapping the filter housing briefly in order to empty it of dust. Note that, during this emptying procedure, membrane 62 preferably remains with adapter 64 and does not interface with emptying filter housing 60.

In the preferred embodiment, filter housing 60 is formed by molding, sinterring or by other means a rigid, porous, plastic material, preferably porous polyethylene, polypropylene, polystyrene, or other polyolefins having a pore size effective to retain sanding dust; it has been found that a pore size of 120–140 microns is satisfactory. In the embodiment shown, filter housing 60 is substantially cylindrical and has an internal diameter of approximately two inches, a length of approximately four inches, and a typical wall thickness of 0.15 inch. Those skilled in the art will recognize that other sizes and shapes of sander filters consistent with the present filter invention may also be useful.

In the sander embodiments shown, pads 22 are typically five inches in diameter and comprise an upper member 66 of fiberglass-reinforced epoxy molded into a lower member 68, which may be formed of integral skin-cast polyurethane. As is familiar to those skilled in the art, for pads used with PSA, a vinyl sheet is typically applied to the lower surface 70 of lower pad member 68. This vinyl material is normally coated such that PSA sandpaper or the like will stick to the surface and yet, when the paper is removed, little or not abrasive will be present on the vinyl sheet. Pads 22 are typically rated for 13,000 RPM. PSA pads with lower surface 70 formed of vinyl or similar material may include an embossed grain applied in a mold (a surface familiar to those skilled in the art used with pressure-sensitive adhesive for adhering materials such as abrasive sheets to the pad). Alternatively, lower surface 70 may be formed of short-stemmed hook and loop material applied in the mold (a surface likewise familiar to those skilled in the art for use in connection with abrasive sheets or the like backed with hook and loop material).

In prior-art sander configurations operating in the random orbit mode, pad 22 is typically free of rotational restraint such that pad 22 may achieve a very high RPM when the motor is running and the sander is lifted off of the work. In such situations, if lower member 68 of pad 22 is formed of typical prior-art materials such as cast polyurethane foam, the pad may expand radially outward. Radial pad expansion in this manner can cause a sanding sheet adhered to the bottom face 70 of the pad to be released when PSA is used to bond the abrasive sheet to the pad. This release of the adhesive sheet has been found to be caused by the differential movement in the interface between bottom surface 70 of the pad and the adjoining layer of the adhesive sheet, resulting in release by the PSA of the sanding sheet. Such released abrasive sheets can be inconvenient to the user.

Accordingly, it has been found that use of an anti-radial-expansion mechanism coupled proximate the lower surface 70 of sanding pad member 68 can substantially prevent radial expansion of the pad and substantially eliminate the problem of PSA bonding failures between the pad and the adhesive sheet. In one preferred embodiment, the anti-radial-expansion system is achieved by molding a layer 72 of vinyl-coated fiberglass insect screening into the lower portion of pad member 68. Such insect screening may have a mesh of 18 by 16 strands per inch with a strand diameter of 0.011 inch. Other similar fiberglass screening or materials may also be used in order to prevent the previously described radial expansion problem. An alternative is use of a square-weaved cloth backing molded into the vinyl coating at the bottom of the pad.

Pads 22 are typically secured to pad support 38 by machine screws 48 passed through mounting holes 74 formed in upper fiberglass member 66. In sanding pads which comprise vacuum holes 76, the vacuum holes are preferably molded in and not machined.

Figure 3:
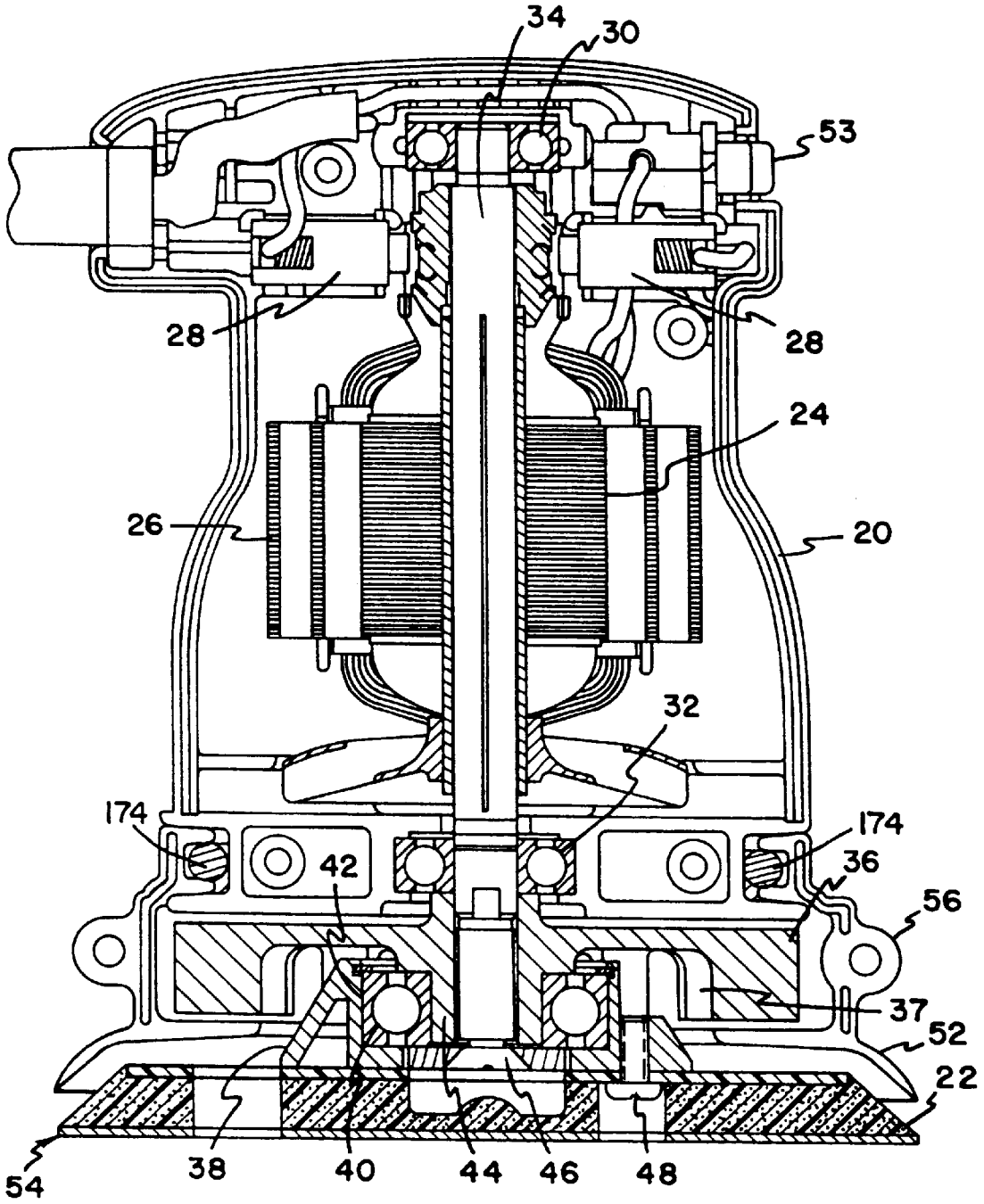
FIG. 3 shows a cross-sectional view of a sander.
Figure 7:
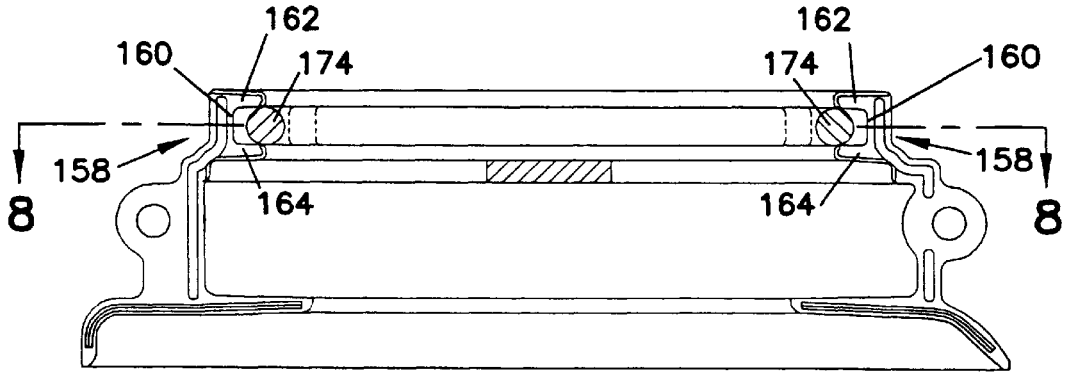
FIG. 7 is a cross-sectional view of an alternative embodiment of a lower housing of a sander.
Figure 8:
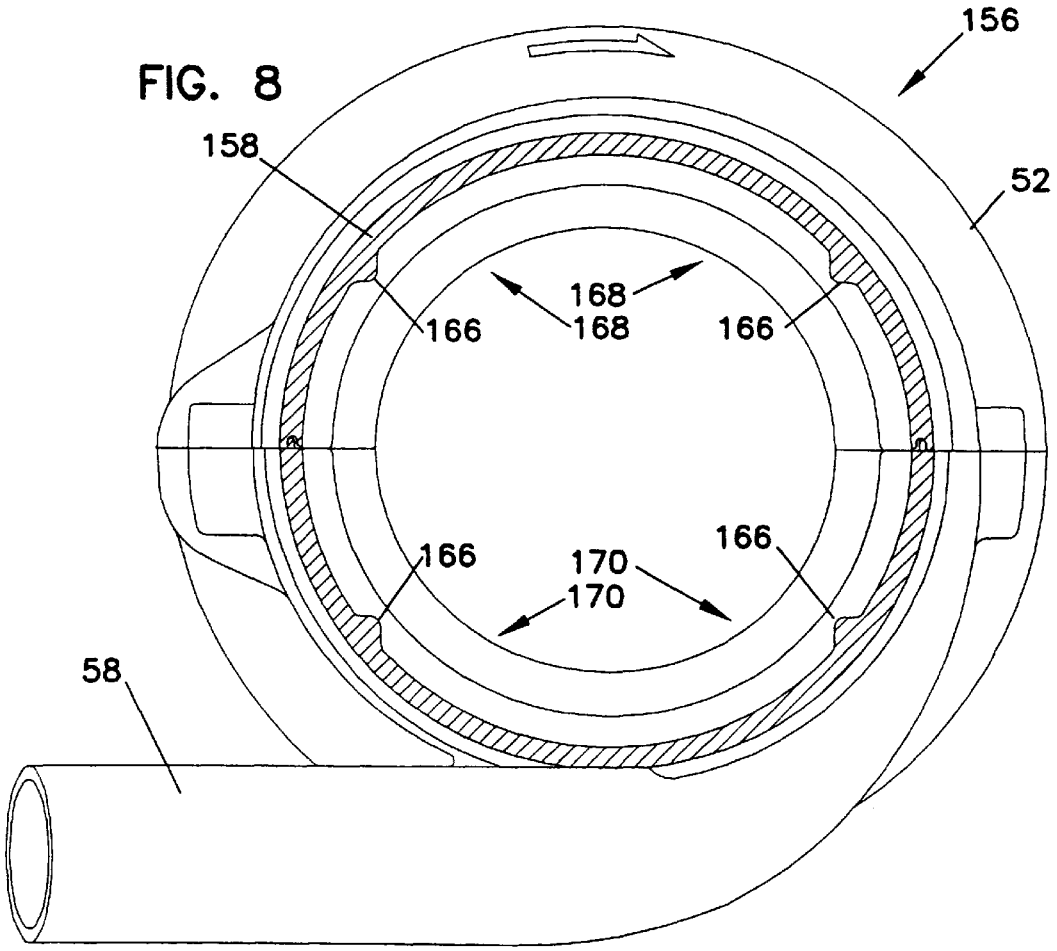
FIG. 8 is a cross-sectional view taken along the line VIII—VIII of FIG. 7.

FIGS. 7 and 8 illustrate an alternative embodiment of a lower housing 156 for the sander. Lower housing 156 is illustrated in cross-section and includes a circular groove 158. Groove 158 may be a C-shaped structure including three walls. The walls shown include a base 160 and two substantially parallel legs 162, 164. Groove 158 is in slidable communication with the exterior portion of sander body 20, as illustrated in FIG. 3. This allows the sander operator to swivel lower housing 156 with respect to sander body 20, and thereby move dust collection channel 58 to a position desired by the sander operator. As explained above, such positioning enables the user to orient the direction of dust collection channel 58 in a preferred direction relative to, for example, power cord 50.

In an alternative embodiment shown in FIGS. 7 and 8, the sander includes bumped or other resistance structure between the housing and the sander body. Generally speaking, the bumped or resistance structure is constructed and arranged for providing static friction which helps to maintain the rotational position of the housing with respect to the sander body during normal sanding, while permitting sliding friction to enable a user to swivel the housing about the sander body, such as by grasping the sander body and the housing and swiveling them with respect to one another, in order to selectively achieve a modified, rotational position of the housing with respect to the sander body. The selectively-achieved, modified rotational position of the housing with respect to the sander body is typically maintained during normal sanding operations by the bumped or resistance structure, until the user pro-actively swivels the housing with respect to the sander body in order to further selectively achieve a new modified, rotational position of the housing with respect to the sander body.

Accordingly, the bumped or resistance structure disclosed in the present application is generally intended to impart a friction between the housing and the sander body sufficient to maintain (or, at least, to help maintain) the respective, rotational position of the housing and the sander body, such as during typical sanding use or in storage, while still permitting relative movement between the housing and the sander body. Thus, the bumped or resistance structure retards relative rotational movement between the housing and the sander body under most circumstances, other than when the user decides to proactively or overtly rotate the housing with respect to the sander body, in order to achieve a new relative position between the housing and the sander body. Once the new position is achieved, the bumped or resistance structure again maintains the new relative position between the housing and the sander body, such as during normal sanding or storage.

As embodied herein, the bumped or resistance structure includes a non-smooth structure which functions to allow lower housing 156 to swivel with respect to sander body 20, but which imparts friction so as to prevent lower housing 156 from swiveling too easily about sander body 20 during use or storage. In the particular embodiment illustrated in FIG. 8, a bumped structure includes a plurality of protuberances or bumps 166 along base 160 of groove 158. In this specific illustrated embodiment, bumps 166 have a semi-oval-shaped cross section. However, it is contemplated that other shapes which perform the function of imparting friction between lower housing 156 and sander body 120 may be used also. For example, knobs, protrusions, bulges, enlargements, nubs, and other shaped structures may be incorporated in base 160 or any of the walls (i.e., base 160, or legs 162, 164) of groove 158. Further, it is contemplated that bumps may be placed on both of legs 162, 164 at the same time. Further, bumped structure may include a roughened or knurled surface on the wall or walls of groove 158, or along an alternative surface between the housing and the sander body. For example, although groove 158 is illustrated as being part of lower housing 156, it is contemplated that the structure could be reversed, and a groove could be placed on sander body 20 instead. In some embodiments, such as when bumps 166 rub directly onto the housing or sander body, bumps 166 may be made of a variety of materials having frictional properties, for example, rubber, an elastomeric composite, or soft or other frictional plastic.

In the embodiment illustrated, bumps 166 include a first pair 168 of bumps on a first half of lower housing 156 and a second pair 170 of bumps located symmetrically opposed to first pair 168. It is contemplated that the specific location of bumps 166 could be in a variety of locations, so long as it achieves the function of imparting friction between lower housing 156 and sander body 20.

In one preferred embodiment, the sander includes an O-ring between the exterior portion of the sander body and the groove. In the particular embodiment shown, an O-ring 174 embraces sander body 20, and is positioned so as to be slidable within groove 158. O-ring 174 also functions to resist motion between sander body 20 and lower housing 156. In the embodiment shown, bumps 166 engage O-ring 174 and help to prevent O-ring 174 from relaxing over time. It also is contemplated that, instead of putting bumps 166 on a wall or walls of groove 158, O-ring 174 could be modified to include bumps along its outer surface to engage groove 158.

It should be appreciated that, when bumps 166 comprise materials having frictional properties (for example, rubber, elastromeric composite, or soft or other frictional plastic, as noted above), it may not be necessary to include an O-ring or similar frictional material between the housing and the sander body. Furthermore, when an O-ring or similar material is used between the housing and the sander body, it may not be necessary to incorporate a bumped or further resistance structure between the housing or sander body other than the O-ring. Furthermore, when an O-ring or similar frictional material is used between the housing and the sander body, bumps 166 may comprise a relatively non-elastic material such as metal or relatively hard plastic, for example.

At the time of filing the present application, preferred embodiments of the sanders disclosed can be obtained from Porter-Cable Corporation, the assignee of the present application, in three models. A model 332 does not incorporate dust collection and includes a PSA pad. A model 333 includes a dust collection system as well as a hook and loop pad. A model 334 is similar to the model 333 except that it incorporates a PSA pad.

The present invention is to be limited only in accordance with the scope of the appended claims, since persons skilled in the art may devise other embodiments still within the limits of the claims.

What is claimed is:

1. A sander comprising:

a sander body;

a motor held by the sander body;

a pad operably connected to the motor so as to impart a sanding motion to the pad, the pad being rotatable about an axis of rotation;

a housing swivellably attached to the sander body, the housing including a dust evacuation port;

at least one of the housing and the sander body including spaced-apart radial walls that extend radially with respect to the axis of rotation and a base wall that extends between the spaced-apart radial walls the spaced-apart radial walls and the base wall cooperating to define a circumferential groove; and one or more bump members that project into the groove and are positioned between the spaced-apart radial walls for assisting in maintaining a rotational position of the housing with respect to the sander body during normal sanding while permitting a user to swivel the housing about the sander body in order to selectively achieve a modified, rotational position of the housing with respect to the sander body.

2. The sander of claim 1, wherein the one or more bump members comprise a plurality of bump members connected to the base wall.

3. The sander of claim 2, wherein the bump members project radially into the groove between the spaced-apart radial walls.

4. The sander of claim 1, wherein the one or more bump members comprise a plurality of bumps integrally formed on the housing.

5. The sander of claim 3, wherein the plurality of bump members includes at least three bumps.

6. The sander of claim 3, wherein the plurality of bump members includes four members symmetrically arranged along the base wall of the groove.

7. The sander of claim 1, further including an O-ring between the sander body and the housing.

8. The sander of claim 7, wherein the one or more bump members engage the O-ring.

9. The sander of claim 1, wherein the housing is attached to a filter housing, the filter housing comprising a rigid, porous material having a pore size effective for entrapping dust which enters the filter housing.

10. The sander of claim 1, wherein the pad is operably connected to the motor so as to impart a random orbit motion to the pad when the motor is operating and the pad is pressed against a workpiece.

11. A sander, comprising:

a sander body including an interior portion and an exterior portion;

a motor held by the sander body;

a pad operably connected to the motor so as to impart a sanding motion to the pad;

a housing swivellably attached to the sander body;

at least one of the sander body and the housing including spaced-apart radial walls at least partially defining a circumferential groove;

an elastomeric ring mounted within the groove between the housing and the sander body, and a plurality of resistance members that project into the groove between the spaced-apart radial walls for compressing the elastomeric ring.

12. The sander of claim 11, wherein the resistance members include a plurality of bumps along a base wall of the groove.

13. The sander of claim 12, wherein the plurality of bumps includes a first pair of bumps and a second pair of bumps symmetrically opposed to the first pair of bumps.

14. The sander of claim 11, wherein the housing includes a dust exhaust channel attached to a filter housing, the filter housing comprising a rigid, porous material having a pore size effective for entrapping dust which enters the filter housing, whereby the filter housing may be swiveled about the sander body.

15. The sander of claim 11, wherein the pad is operably connected to the motor so as to impart a random orbit sanding motion to the pad when the motor is operating and the pad is urged against a workpiece.

16. The sander of claim 15, wherein the housing includes a skirt extending over a peripheral portion of the pad.

17. The sander of claim 16, wherein the sander body is sized for a palm grip at a top of the sander body and for a single-handed grip around the sander body, wherein the skirt helps to prevent fingers of the user's hand from contacting the peripheral portion of the pad whenever the fingers of the user's hand are near the skirt.

18. A sander comprising:

a sander body;

a motor held by the sander body;

a pad operably connected to the motor so as to impart a sanding motion to the pad;

a housing swivellably attached to the sander body, the housing including a dust evacuation port;

at least one of the housing and the sander body including spaced-apart annular walls and a base wall that extends between the spaced-apart annular walls, the spaced-apart annular walls and the base wall cooperating to define a circumferential groove; and a plurality of resistance members fixedly connected to the base wall that project into the groove and are positioned between the spaced-apart annular walls for assisting in maintaining a rotational position of the housing with respect to the sander body during normal sanding, while permitting a user to swivel the housing about the sander body in order to selectively achieve a modified, rotational position of the housing with respect to the sander body.

* * * * *